US006520378B1

(12) United States Patent
Goettner et al.

(10) Patent No.: US 6,520,378 B1
(45) **Date of Patent: *Feb. 18, 2003**

(54) DUAL-OUTLET DISPENSING CLOSURE

(75) Inventors: Michael K. Goettner, Sylvania, OH (US); Eugene F. Haffner, Waterville, OH (US); Jon B. Ogilvie, Perrysburg, OH (US); Gregory A. Geisinger, Toledo, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/974,692

(22) Filed: Oct. 9, 2001

Related U.S. Application Data

(62) Division of application No. 09/443,827, filed on Nov. 19, 1999.

(51) Int. Cl.[7] ..... B65D 35/28

(52) U.S. Cl. ..... 222/94; 222/129; 222/145.3; 222/482; 222/536

(58) Field of Search ..... 222/94, 145.3, 222/145.5, 129, 534, 536, 533, 481, 482, 484

(56) References Cited

U.S. PATENT DOCUMENTS

| | | | |
|---|---|---|---|
| 2,661,870 | A | 12/1953 | Huenergardt |
| 3,089,626 | A | 5/1963 | Kubiliunas |
| 3,542,256 | A | 11/1970 | Waterman |
| 3,729,553 | A | 4/1973 | Gold et al. |
| 4,015,756 | A | 4/1977 | Beck |
| 4,271,984 | A | 6/1981 | Ducross et al. |
| 5,054,662 | A | 10/1991 | Santagiuliana |
| 5,137,178 | A | 8/1992 | Stokes et al. |
| 5,289,950 | A | 3/1994 | Gentile |
| 5,356,044 | A | 10/1994 | LaVange |
| 5,392,947 | A | 2/1995 | Gentile |
| 5,873,478 | A | 2/1999 | Sullivan et al. |
| 5,873,494 | A | 2/1999 | Dallas, Jr. |
| 5,882,574 | A | 3/1999 | Geisinger |

*Primary Examiner*—Philippe Derakshani
*Assistant Examiner*—Melvin A Cartagena

(57) ABSTRACT

A dual-outlet dispensing closure for dispensing fluid products from a dual-chamber container that includes a base for securement to a container and having laterally adjacent outlet openings for alignment with outlets in the container. A turret is mounted on the base for conjoint pivotal movement of dual outlet passages between a closed position in which the turret blocks the outlet openings in the base, and an open position in which the turret passages are aligned with and open to the outlet openings to dispense product. The passages are preferably provided in the form of elongated barrels that are angulated with respect to each other so that the fluid products dispensed from the respective barrels meet and mix with each other at a position spaced from the closure. The base preferably includes vent openings for venting the container chambers to atmosphere as products are dispensed from the container.

17 Claims, 4 Drawing Sheets

DUAL-OUTLET DISPENSING CLOSURE

This application is a division of application Ser. No. 09/443,827 filed Nov. 19, 1999.

The present invention is directed to closures and packages for dispensing fluid products. The present invention is more specifically directed to a dual-outlet dispensing closure for dispensing fluid products from associated chambers of a dual-chamber container, to a package that comprises a dual-outlet dispensing closure on a dual-chamber container, to a method of manufacturing such a closure, and to a method of dispensing fluid products from a dual-chamber container through a dual-outlet dispensing closure.

BACKGROUND AND OBJECTS OF THE INVENTION

It has heretofore been proposed in the art to provide similar or dissimilar fluid products, particularly liquid products, within different chambers of a single container package. Dispensing closures for such containers generally include dual outlets, one for dispensing product from each of the container chambers. Product flows are provided in generally parallel streams, which may be directed by a user into a single measuring cup, for example, or may be dispensed directly for use. Liquid detergent and bleach, for example, may be dispensed into a measuring cup, or directly into a washing machine. However, when dispensed directly into a washing machine, for example, the liquid products may not become thoroughly mixed before being brought into contact with the laundry.

It is therefore a general object of the present invention to provide a dual-outlet dispensing closure that is economical to manufacture, and that can be readily provided in configurations for use in conjunction with differing containers. Another object of the present invention is to provide a dual-outlet dispensing closure that includes a plastic base and a plastic turret for mounting on the base, in which the base can be provided in differing forms for securement to differing stock containers while using a turret of a single design. Yet another object of the present invention is to provide a dual-outlet dispensing closure that is configured to mix the fluid products as the products are dispensed, at a position spaced from the closure, so that the products can become thoroughly mixed before use, but do not come into contact with each other or mix at the closure itself. Yet another object of the present invention is to provide a package that comprises a dual-outlet dispensing closure and a dual-chamber container that achieves one or more of the objects set forth above. A further object of the invention is to provide a method of manufacturing a dual-outlet dispensing closure of the type described, and a method of dispensing and mixing two fluid products in which the products are mixed in flight between the dispensing package and the point of use.

SUMMARY OF THE INVENTION

A dual-outlet dispensing closure for dispensing fluid products from a dual-chamber container in accordance with one aspect of the present invention includes a base for securement to a container and having laterally adjacent outlet openings for alignment with outlets in the container. A turret is mounted on the base for conjoint pivotal movement of dual outlet passages between a closed position in which the turret blocks the outlet openings in the base, and an open position in which the turret passages are aligned with and open to the outlet openings to dispense product.

The passages are preferably provided in the form of elongated barrels that are angulated with respect to each other so that the fluid products dispensed from the respective barrels meet and mix with each other at a position spaced from the closure. The base preferably includes vent openings for venting the container chambers to atmosphere as products are dispensed from the container.

The closure base in the preferred embodiment of the invention includes a base wall having a recess or pocket in which the outlet openings are disposed, and the turret is pivotally secured to the base within this pocket. The pocket preferably has an arcuate base wall within which the outlet openings are disposed, and the turret has a cylindrical base pivotally mounted within the pocket, with the outlet passages extending through the turret base. The turret includes a top wall integrally interconnecting the barrels that form the outlet passages, which is contoured to be flush with the top wall of the base in the closed position of the turret. The turret is received by snap-fit within the pocket in the base by means of lugs that slidably engage the cylindrical base of the turret. The cylindrical turret base is preferably formed by a split cylindrical shell through which the passage barrels extend. The closure base is secured to the container in the preferred embodiment of the invention by means of one or more skirts received over and engaged with one or more corresponding cylindrical finishes on the dual-chamber container.

In accordance with other aspects of the present invention, a package for dispensing fluid products comprises a dual-chamber container having laterally adjacent outlets and a dual-outlet dispensing closure as previously described. A method of dispensing and mixing two fluid products includes the steps of placing the fluid products in respective chambers of a dual-chamber container that has laterally adjacent outlets from the chambers, securing to the container a dual-outlet dispensing closure that has dispensing openings so oriented with respect to each other that fluid products poured from the chambers through the openings meet and mix with each other at a position spaced from the closure, and pouring the products from the container through the closure. The dual-outlet dispensing closure in accordance with the invention preferably is made by providing a plastic base, a plastic turret, and securing the turret to the base.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
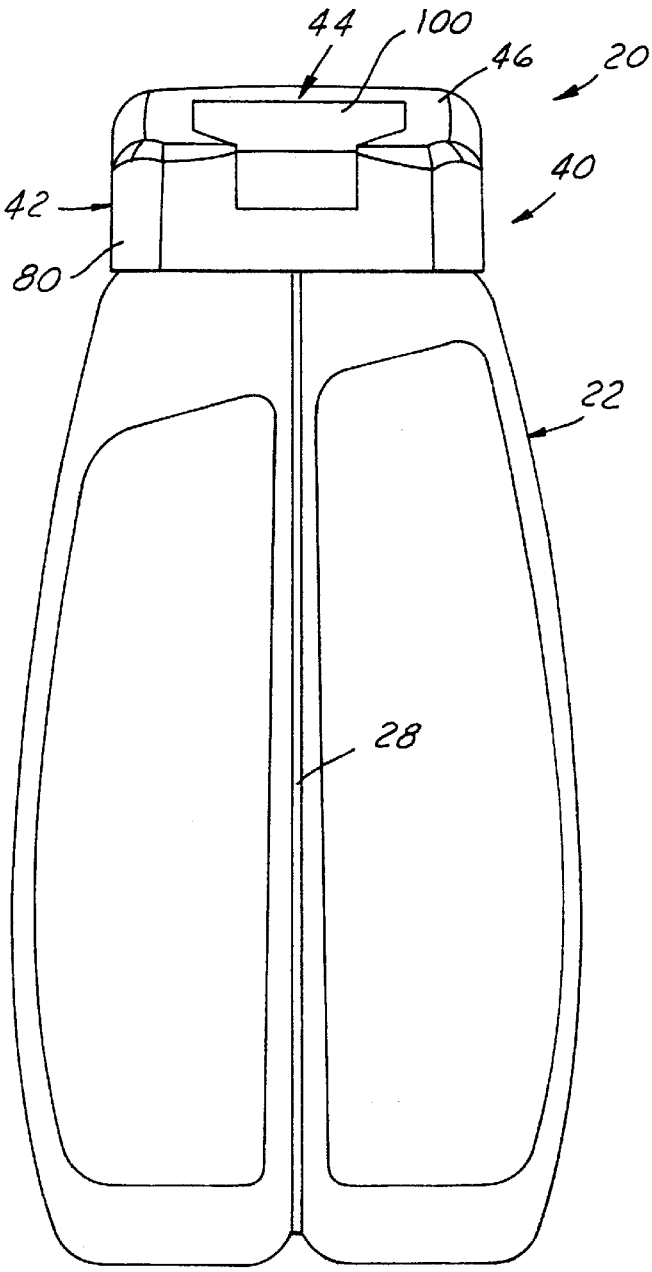
FIG. 1 is a front elevational view of a dual-outlet dispensing package in accordance with one presently preferred embodiment of the invention.

FIGS. 1–5 illustrate a package 20 for dispensing fluid products in accordance with one aspect of the present invention. Package 20 includes a dual-chamber container 22 having dual internal chambers 24, 26 (FIG. 5) separated from each other by an internal wall or septum 28. Each container chamber 24, 26 terminates in an associated generally cylindrical finish 30, 32 that form laterally adjacent parallel outlets from the associated chambers. The upper surfaces of finishes 30, 32 are flat and coplanar. Each finish 30, 32 has an associated external bead 34, 36 that extends entirely around the associated finish, and which are coplanar with each other. Container 22 is of one-piece molded plastic construction, and may be formed by any suitable molding operation. Septum 28 that divides chambers 24, 26 may be formed, for example, in accordance with the technique illustrated in U.S. Pat. No. 5,882,574. Alternatively, but less preferably, container 22 may be formed by separate container sections that have walls adhered or otherwise secured to each other to form septum 28.

A dual-outlet dispensing closure 40, in accordance with a presently preferred embodiment illustrated in FIGS. 1–5, comprises a molded plastic base 42 and a separately molded plastic turret 44. Base 42 includes a flat forwardly and downwardly angulated base wall 46 that has a central pocket or recess 48. (Directional adjectives such as "forwardly" and "downwardly" are taken with respect to the orientations of FIGS. 1–2.) Pocket 48 has an arcuate part-cylindrical bottom wall 50, a flat back wall 52 and a parallel front wall, and flat parallel sidewalls 54, 56. Walls 50–56 are mutually orthogonal. Spaced aligned laterally extending lugs 58, 60 are formed on back wall 52 for pivotally retaining turret 44 in pocket 48, as will be described. Angulated base wall 46 has a recess 62 at the lower front edge thereof for manual engagement of turret 44 to pivot the turret upwardly away from base wall 46.

A pair of laterally spaced outlet openings 64, 66 are disposed in bottom wall 50 of pocket 48. Likewise, a pair of vent openings 68, 70 are formed in bottom wall 50, each positioned adjacent to but spaced rearwardly and outwardly from an associated outlet opening 64, 66. Each outlet opening 64, 66 and its associated air vent opening 68, 70 opens at a raised island on bottom wall 50 for sliding and sealing engagement with turret 44, as will be described. Two pair of coaxial annular skirts 72, 74 and 76, 78 depend from wall 46 of base 42 for receipt over the upper end of associated finishes 30, 32. That is, skirt 72 is received within finish 30 while skirt 74 is externally received over finish 30, with a circumferentially segmented bead 75 received over bead 34. Likewise, skirt 76 is received within finish 32, while skirt 78 is externally received over finish 32, with a circumferentially segmented bead 79 received over bead 36. An external skirt 80 depends from the periphery of base wall 46 to match the external contour of container 22 (FIGS. 1 and 2), and to cover the container finishes and associated skirts. A vent pipe 82, 84 extends downwardly from each vent opening 68, 70 to vent each chamber to the atmosphere as product is poured from the chamber.

Figure 8:
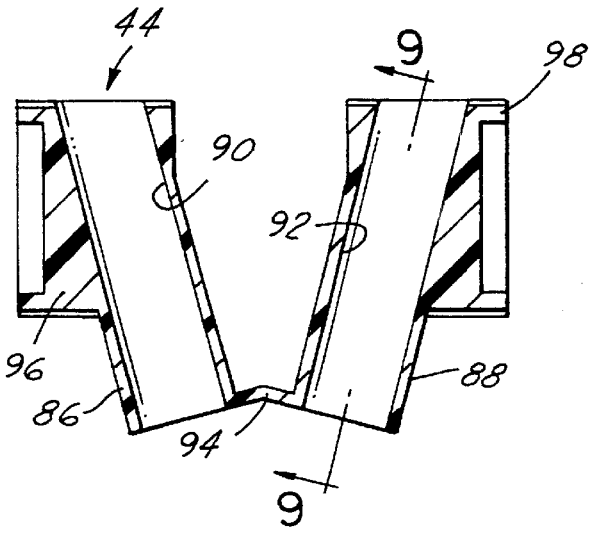
FIGS. 8 and 9 are sectional views taken substantially along the respective lines 8—8 in FIG. 7 and 9—9 in FIG. 8.
Figure 9:
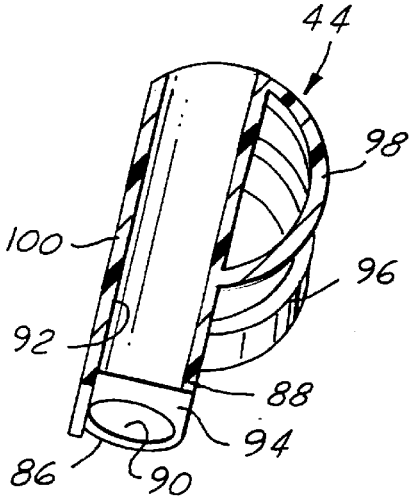

Turret 44 is of one-piece molded plastic construction, and comprises a pair of elongated cylindrical barrels 86, 88, each having an associated internal cylindrical passage 90, 92. Barrels 86, 88 are angulated with respect to each other, as best seen in FIG. 8, and have outer ends integrally joined by a web 94. The opposing or inner end of each barrel is encircled by associated portions 96, 98 of a split cylindrical base. A flat wall 100 overlies barrels 86, 88 and base 96, 98.

Figure 2:
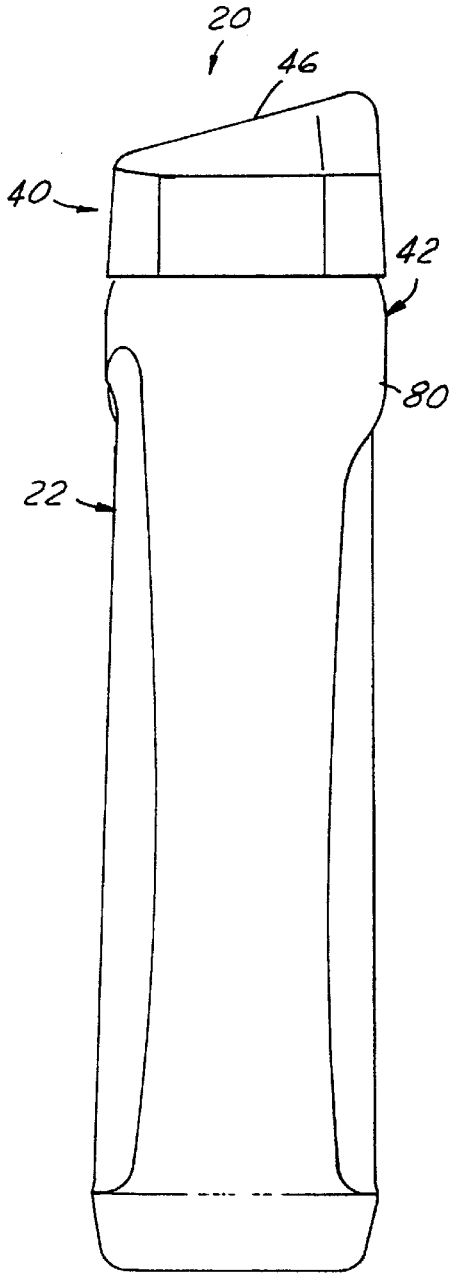
FIG. 2 is a side elevational view of the package illustrated in FIG. 1.
Figure 3:
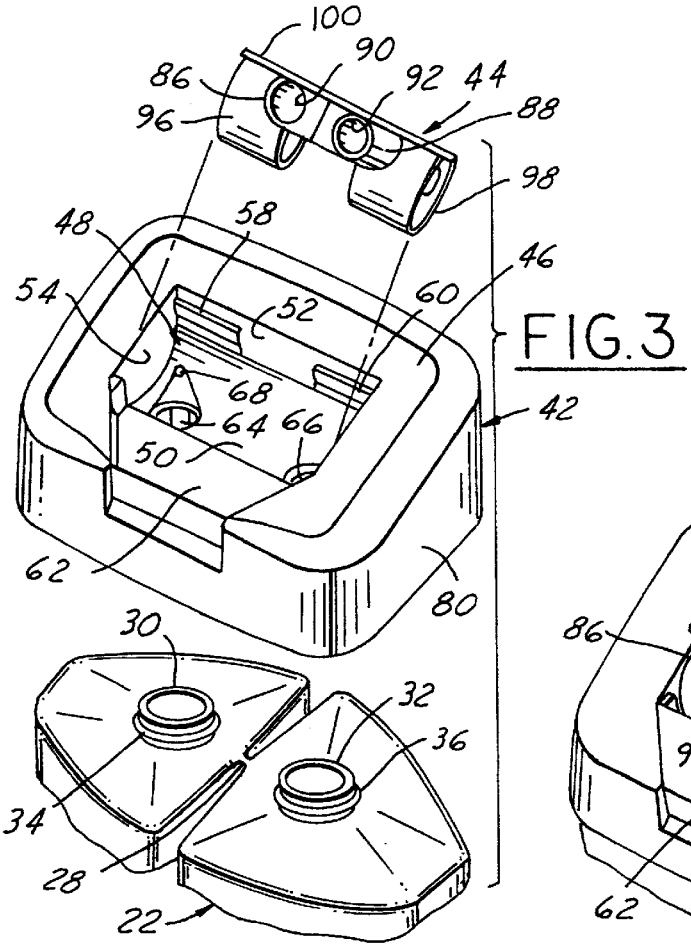
FIG. 3 is a fragmentary exploded perspective view of the package illustrated in FIG. 1.
Figure 4:
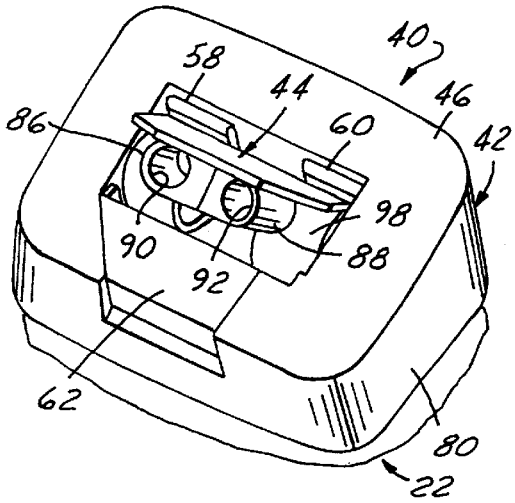
FIG. 4 is a fragmentary perspective view of the outlet portion of the package in FIG. 1 with the outlet turret in the open position.
Figure 5:
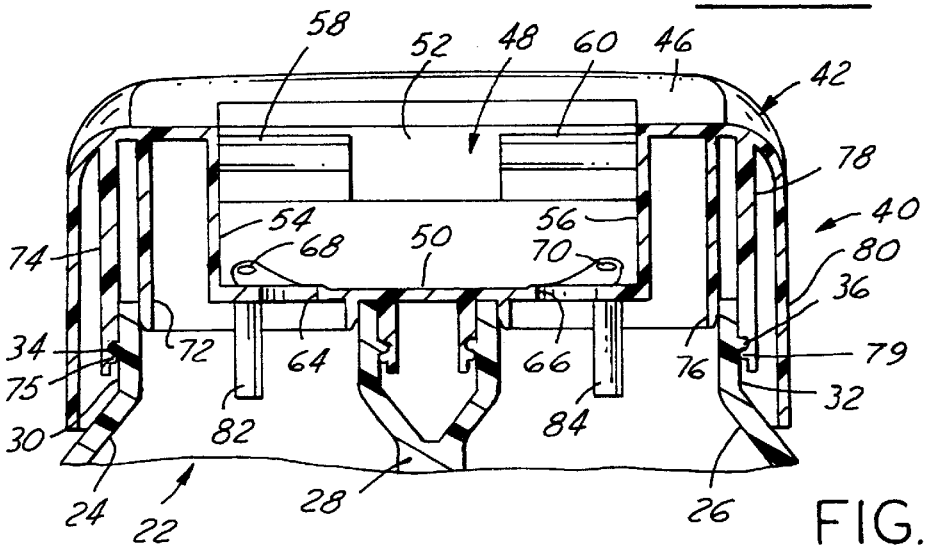
FIG. 5 is a fragmentary sectional view of the outlet portion of the package.
Figure 6:
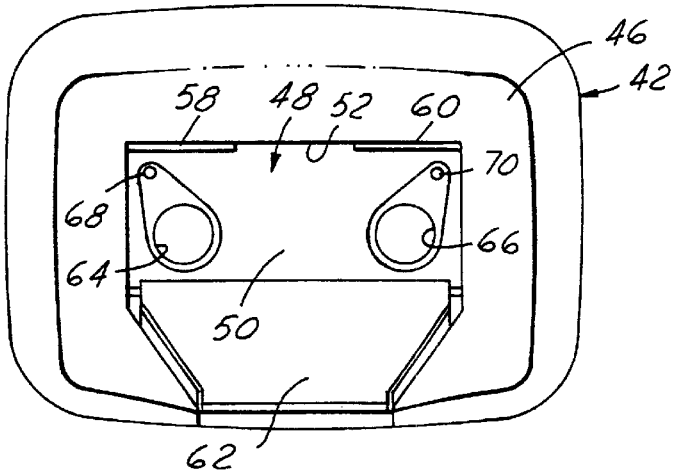
FIG. 6 is a top plan view of the base in the dual-outlet dispensing closure illustrated in FIGS. 1–5.
Figure 7:
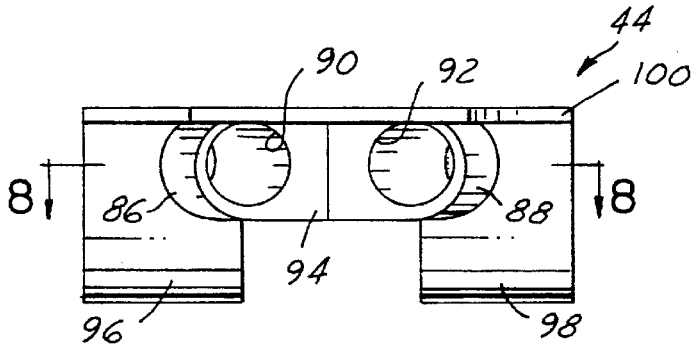
FIG. 7 is a front elevational view of the turret in the dual-outlet dispensing closure illustrated in FIGS. 1–5.

Wall 100 and web 94 join barrels 86, 88 and base portions 96, 98 into an integral unit of light weight but substantial strength. In one currently preferred embodiment of the invention, the angle between the axes of barrels 86, 88 is 29°. The ends of barrels 86, 88 are perpendicular to the respective barrel axes, and thus at an angle of 151° to each other. In this embodiment, the axes of barrels 86, 88 are spaced 0.576 inches from each other at the front ends of the barrels. Wall 100 extends forwardly from the ends of the barrels. In assembly to closure base 42, turret cylindrical base 96, 98 is received by snap-fit within pocket 48, with lugs 58, 60 overlying the cylindrical base in sliding engagement therewith. Base portions 96, 98 are also in sliding sealing engagement with the raised islands of pocket wall 50 that surround dispensing openings 64, 66 and vent openings 68, 70. When turret 44 is in the closed position (FIGS. 1 and 2), turret cylindrical base portions 96, 98 seal dispensing openings 64, 66 and vent openings 68, 70 in base 42 so as to prevent leakage of product. Turret wall 100 is flush with the top surface of base wall 46. The front edge of wall 100 is adjacent to the front edge of recess 62, and barrels 86, 88 are hidden (FIGS. 1 and 2). When turret 44 is pivoted upwardly about base 96, 98 within recess 44, passages 90, 92 formed by barrels 86, 88 are brought into alignment with dispensing openings 64, 66 of base 42. When the turret is fully open, vent openings 68, 70 are exposed by wall 100. With the turret in its open position, product may be dispensed from container 22 by tilting and pouring from the container. That is, it is not necessary to squeeze the container because the container chambers are vented to atmosphere, so that the liquid products may flow freely from the container. The angulated orientations of barrels 86, 88 ensure that the liquid products from the separate container chambers will meet and mix with each other a few inches from the turret, and thus be thoroughly mixed before entering the area of use. After pouring product from the container, the turret may be returned to the closed position, providing the turret base in the form of split hollow cylindrical sections 96, 98 rather than a solid cylinder reduces the amount of plastic needed to form the turret, and thus reduces turret weight and cost.

Figure 10:
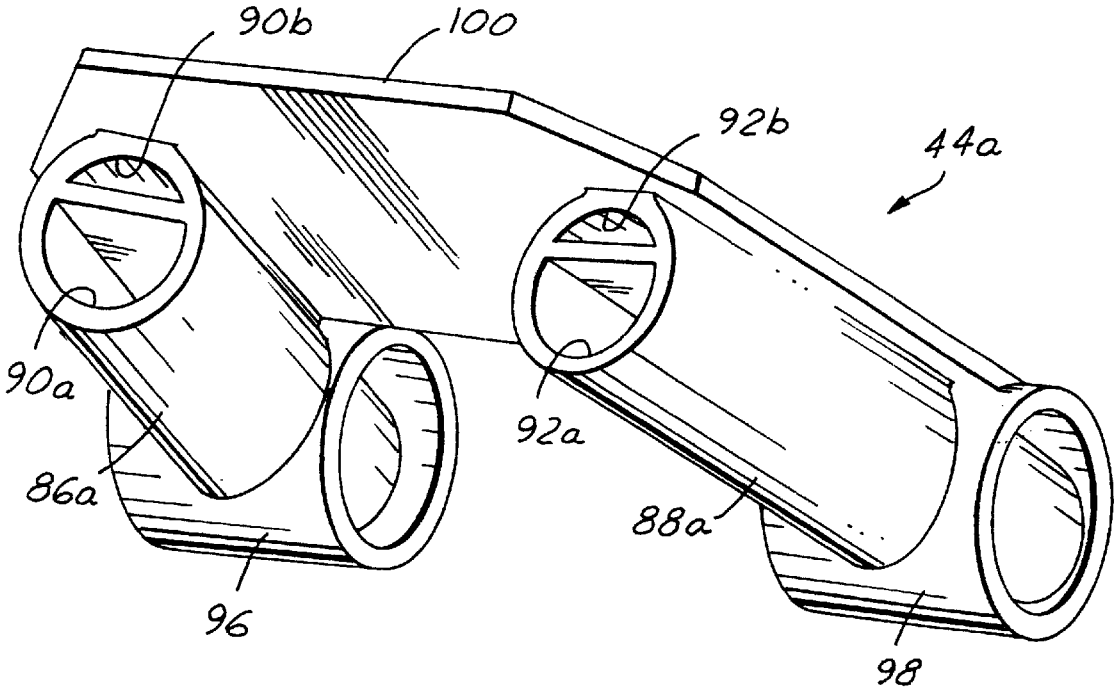
FIG. 10 is a perspective view of a dual-outlet dispensing closure turret in accordance with a modified embodiment of the invention.

FIG. 10 illustrates a modified turret 44*a*, in which components identical to those described in connection with turret 44 are indicated by associated identical reference numerals, and modified components are illustrated by associated reference numerals and a letter suffix: Turret 44*a* differs from turret 44 primarily in that each barrel 86*a*, 88*a* is split by an associated dividing wall 86*b*, 88*b* to form a lower passage 90*a*, 92*a* for dispensing product, and an upper passage 90*b*, 92*b* for alignment with associated vent openings 68, 70 for flow of vent air into the container chambers.

There have thus been disclosed a dual-outlet dispensing closure, a method for manufacturing such a closure, a package containing such a closure and a method for dispensing products from a dual-chamber container, which fully satisfy all of the objects and aims previously set forth. A single turret 44 or 44*a* can be used in conjunction with bases 42 of multiple differing configurations to accommodate dual-chamber containers of differing outlet and/or peripheral configurations. For example, the illustrated dual outlet dispensing closure can be readily modified for use in combination with the D-shaped chamber outlet openings illustrated in U.S. Pat. No. 5,882,574 by modifying the configurations of skirts 72–80. The container, closure base and closure turret are all of inexpensive molded plastic construction in accordance with the preferred implementations of the invention. Several alternatives and modifications have been described. Other alternatives and modifications will readily suggest themselves to persons of ordinary skill in the art. The invention is intended to embrace all such alternatives and modifications as fall within the spirit and broad scope of the appended claims.

What is claimed is:

1. A method of making a dual-outlet dispensing closure for fluid products, which comprises the steps of:

(a) providing a base having means for securement to a container, and a pocket with an arcuate base wall and laterally adjacent outlet openings in said base wall, (b) providing a turret having a cylindrical base and a pair of outlet barrels extending through and from said base for conjoint movement with said base, and (c) mounting said base of said turret within said pocket for pivoting said turret in said pocket between a closed position in which said turret base blocks said outlet openings and an open position in which said outlet barrels are aligned with and open to said outlet openings.

2. The method set forth in claim 1 wherein said step (b) is such that said barrels have axes at an acute angle to each other, such that fluid products dispensed through said barrels meet and mix with each other at a position spaced from said closure.

3. The method set forth in claim 1 wherein said step (a) includes providing vent openings in said arcuate base wall.

4. The method set forth in claim 3 wherein said vent openings are positioned in said base wall adjacent to said outlet openings for registry with said barrels in said open position of said turret.

5. The method set forth in claim 4 wherein said step (b) includes providing vent passages in said barrels for alignment with said vent openings in said open position of said turret.

6. The method set forth in claim 1 wherein said step (b) includes providing a top wall integrally interconnecting said barrels and disposed to be flush with a top wall of said base in said closed position of said turret.

7. The method set forth in claim 1 where said step (c) includes securing said turret by snap fit within said pocket.

8. The method set forth in claim 7 wherein said turret base comprises a hollow cylindrical shell through which said barrels extend.

9. The method set forth in claim 8 wherein said shell comprises a split shell having portions encircling one end of each said barrel.

10. A method of making a dual-outlet dispensing closure for fluid products, which comprises the steps of:

(a) providing a base having means for securement to a container, and a pocket with an arcuate base wall, a pair of laterally adjacent outlet openings in said base wall, and a pair of vent openings in said base wall respectively adjacent to said outlet openings, (b) providing a turret having a cylindrical base and a pair of outlet barrels extending through and from said base for conjoint movement with said base, said barrels having respective axes at an acute angle to each other, and (c) mounting said base of said turret within said pocket for pivoting said turret between a closed position in which said base of said turret blocks said outlet and vent openings, and an open position in which said outlet barrels are aligned with and open to respective outlet openings and said vent openings are open to atmosphere.

11. The method set forth in claim 10 wherein said step (a) and (b) are such that said vent openings open into said barrels in said open position of said turret.

12. The method set forth in claim 11 wherein said step (b) includes providing vent passages in said barrels for alignment with said vent openings in said open position of said turret.

13. The method set forth in claim 10 wherein said step (b) includes providing a top wall integrally interconnecting said barrels and disposed to be flush with a top wall of said base in said closed position of said turret.

14. A package for dispensing fluid products, which comprises:

a dual-chamber container having laterally adjacent outlets, and a dual outlet dispensing closure that includes:

a base having means securing said base to said container, and a pocket with an arcuate base wall and laterally adjacent outlet openings in said base wall aligned with said container outlets, and a turret having a cylindrical base pivotally mounted within said pocket and a pair of outlet barrels extending through and from said base for conjoint pivotal movement between a closed position in which said turret base blocks said outlet openings and an open position in which said outlet barrels are aligned with and open to said outlet openings to dispense product, said barrels having respective passages that do not intersect each other such that products dispensed through said barrels are free of contact with each other until after emerging from said barrels.

15. The package set forth in claim 14 wherein said barrel passages have axes at an acute angle to each other, such that products dispensed from said passages meet and merge at a position spaced from said barrels and said package.

16. The package set forth in claim 14 wherein said base wall includes vent openings for venting the container chambers to atmosphere as product is dispensed from the container.

17. The package set forth in claim 16 wherein said turret includes vent passages for alignment with said vent openings when said turret is in said open position.

* * * * *